US007794282B1

(12) United States Patent
Barger

(10) Patent No.: US 7,794,282 B1
(45) Date of Patent: Sep. 14, 2010

(54) LAMP SOCKET ADAPTER/CONVERTER

(76) Inventor: John Edward Barger, 780 S. Floyd Rd., Dallas, TX (US) 75080

( * ) Notice: Subject to any disclaimer, the term of this patent is extended or adjusted under 35 U.S.C. 154(b) by 0 days.

(21) Appl. No.: 12/481,535

(22) Filed: Jun. 9, 2009

(51) Int. Cl.
*H01R 25/00* (2006.01)

(52) U.S. Cl. ..... 439/646

(58) Field of Classification Search ..... 439/236, 439/642, 645, 646; 315/56, 57, 58
See application file for complete search history.

(56) References Cited

U.S. PATENT DOCUMENTS

| | | | | |
|---|---|---|---|---|
| 1,005,163 | A | 10/1911 | Conrad | |
| 1,274,380 | A | 8/1918 | Brislin | |
| 2,279,635 | A | 4/1942 | Morley | |
| 2,505,993 | A * | 5/1950 | Rogers | 315/58 |
| 3,815,080 | A | 6/1974 | Summa | |
| 4,443,778 | A | 4/1984 | Mewissen | |
| 4,683,402 | A | 7/1987 | Aubrey | |
| 4,688,874 | A | 8/1987 | Bjorkman | |
| 4,695,767 | A * | 9/1987 | Wittmann | 315/58 |
| 4,746,840 | A | 5/1988 | Lim | |
| 4,888,678 | A | 12/1989 | Sundhar | |
| 4,891,558 | A | 1/1990 | Tschuk | |
| 4,928,032 | A | 5/1990 | Skoch et al. | |
| 5,128,847 | A | 7/1992 | Lin et al. | |
| 5,239,233 | A | 8/1993 | Nilssen | |
| 5,320,548 | A * | 6/1994 | Schadhauser | 439/236 |
| 5,390,096 | A | 2/1995 | DeKleine et al. | |
| 5,596,247 | A * | 1/1997 | Martich et al. | 315/56 |
| 5,864,461 | A * | 1/1999 | Cho | 361/674 |

* cited by examiner

*Primary Examiner*—Neil Abrams
(74) *Attorney, Agent, or Firm*—Daniel V. Thompson

(57) ABSTRACT

A lamp socket adapter/converter has a main body with a medium screw-base male lamp connector on a lower end and a mount on an upper end. Standoffs extend from the mount parallel and spaced from a central axis. A printed circuit board has holes engaged with medial portions of the standoffs, and a mounting plate fixed to a female bi-pin socket is engaged with the terminal ends of the standoffs. Circuit components on the circuit board convert the electricity present at the lower end lamp connector to a different form of electricity provided to the bi-pin socket. Potting material surrounds an upper portion of the mount, the printed circuit board, the circuit components, the mounting plate and a lower portion of the bi-pin socket.

18 Claims, 3 Drawing Sheets

LAMP SOCKET ADAPTER/CONVERTER

BACKGROUND OF THE INVENTION

The present invention relates in general to electric light equipment. More specifically, but without restriction to the particular use which is shown and described, this invention relates to an improved mounting arrangement for adapting structure and converter circuitry.

It is often desirable to adapt a conventional light bulb socket to a different type of bulb and by changing both the socket type and the form of electricity passing through the fixture. For example, many older outdoor landscape designs use conventional medium screw-based flood lamp fixtures supplied with household 110V AC electricity, but a better choice today is any number of low voltage (12V) bi-pin lamps. A need has therefore arisen for a device that not only adapts screw-based sockets to bi-pin bulbs but also converts or transforms the voltage of the electricity.

SUMMARY OF THE INVENTION

A lamp socket adapter/converter has a main body with a medium screw-base male lamp connector on a lower end and a mount on an upper end. Standoffs extend from the mount parallel and spaced from a central axis. A printed circuit board has holes engaged with medial portions of the standoffs, and a mounting plate fixed to a female bi-pin socket is engaged with the terminal ends of the standoffs. Circuit components on the circuit board convert the electricity present at the lower end lamp connector to a different form of electricity provided to the bi-pin socket. Potting material surrounds an upper portion of the mount, the printed circuit board, the circuit components, the mounting plate and a lower portion of the bi-pin socket.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

Figure 1:
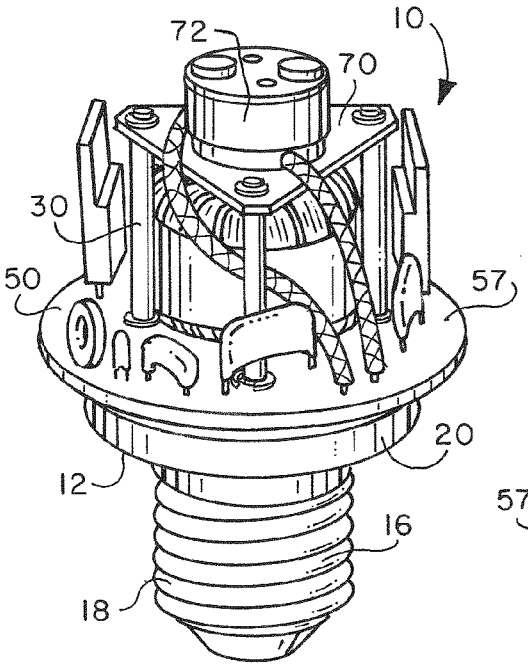
FIG. 1 is a perspective view of the Lamp Socket Adapter/converter of the present invention with the potting material omitted.
Figure 2:
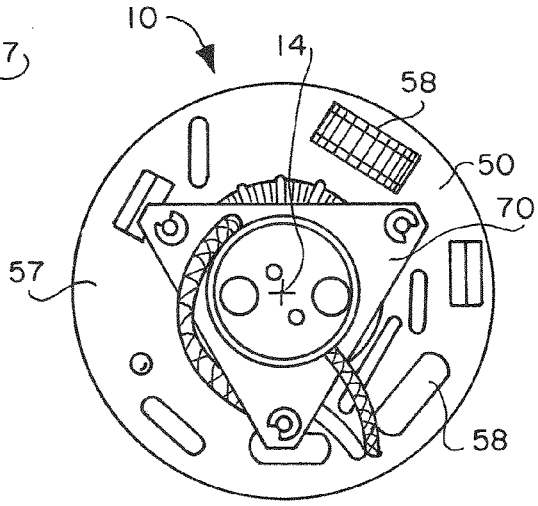
FIG. 2 is a top view of the Lamp Socket Adapter/converter of FIG. 1.
Figure 3:
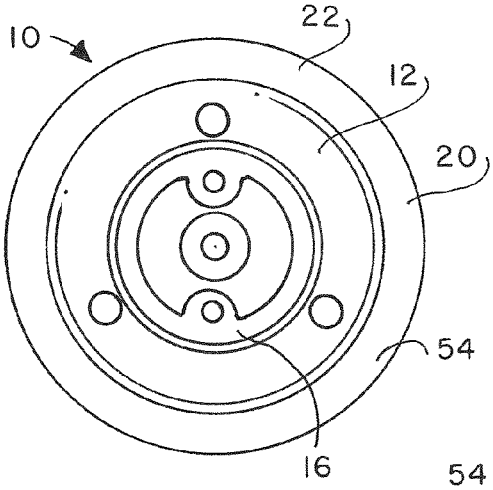
FIG. 3 is a bottom view of the Lamp Socket Adapter/converter of FIG. 1.
Figure 4:
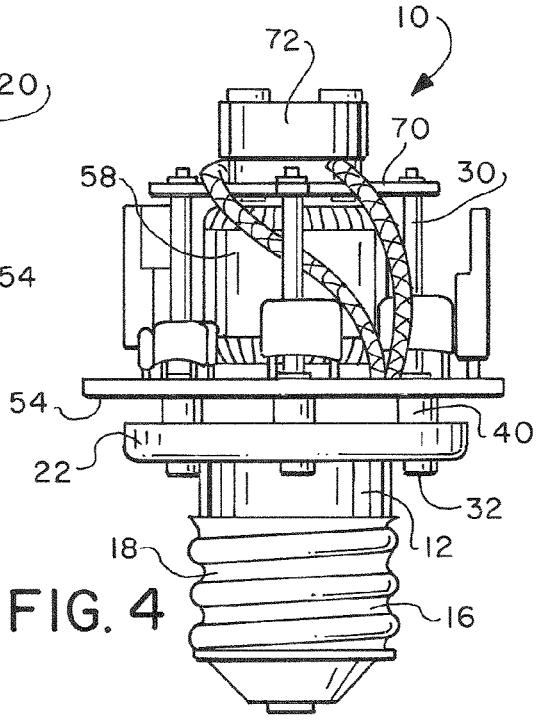
FIG. 4 is a side view of the Lamp Socket Adapter/converter of FIG. 1.
Figure 5:
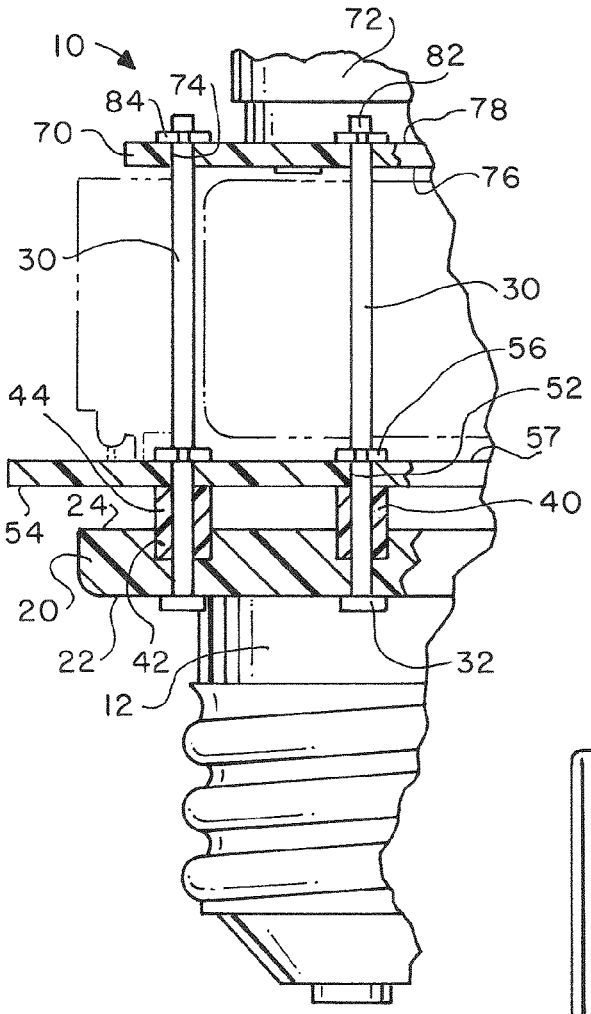
FIG. 5 is a partially broken away side view of the Lamp Socket Adapter/converter of FIG. 1.
Figure 6:
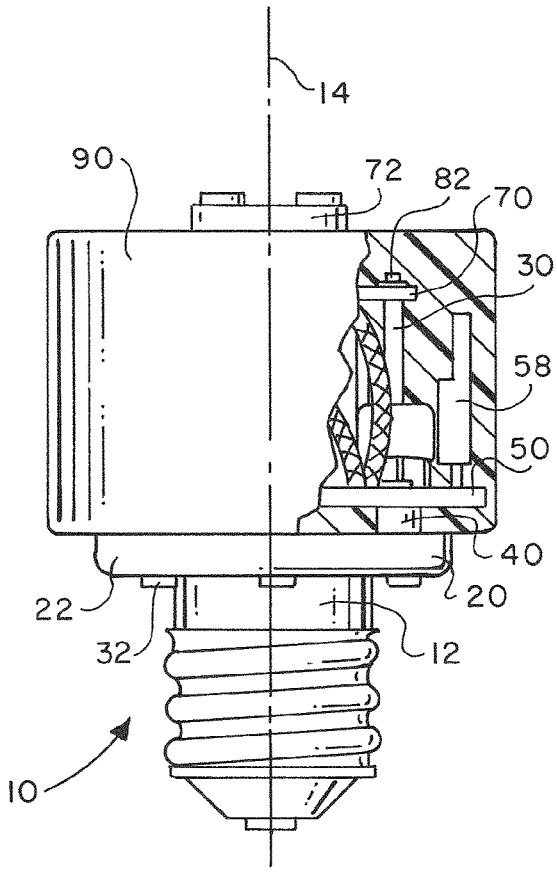
FIG. 6 is a partially broken away side view with potting material shown.
Figure 7:
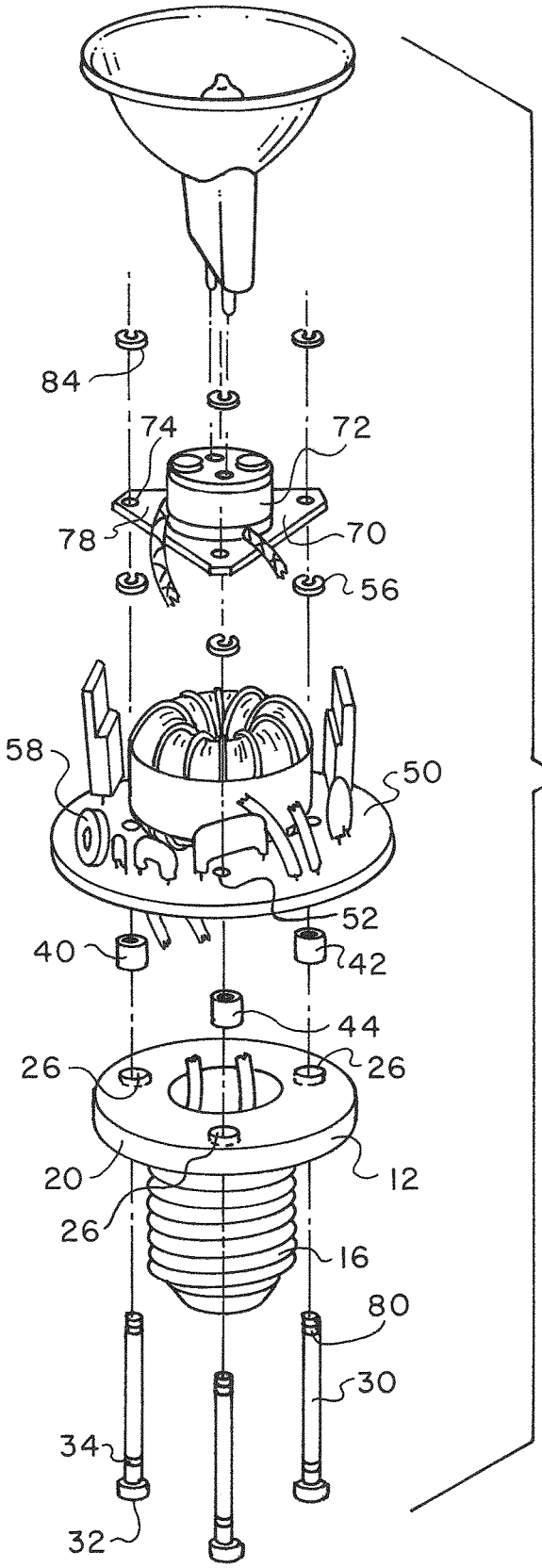
FIG. 7 is an exploded view of the Lamp Socket Adapter/converter.

Referring to FIGS. 1-7, where like numerals refer to like and corresponding parts, a lamp socket adapter/converter 10 has a main body 12 having a central axis 14 (FIGS. 2 and 6) and with a medium screw-base male lamp connector 16 on a lower end 18 and an annular mounting disk 20 on an upper end 22. "Upper" and "lower" are used herein as easily-understood references to the positioning of parts when the device is in the position shown in the FIGURES, although in use the device could be in all different positions.

The mounting disk 20 has lower and upper planar annular surfaces 22,24 parallel to each other and perpendicular to the central axis 14. Cylindrical internal walls in the mounting disk 20 define three holes 26 extending from the lower to the upper annular surfaces 22,24. The holes 26 are parallel to the central axis 14 and equally-spaced in the mounting disk 20 to form an equilaterally-triangular pattern centered about the central axis 14.

Three standoffs 30 extend one each through the three holes 26. The standoffs are cylindrical rods with enlarged ends 32 adjacent the lower annular mounting disk surface 22. Lower retaining ring grooves 34 (FIG. 7) in the standoffs are spaced equidistantly along the standoffs from the upper annular mounting disk surface 24.

Insulating spacers 40 are tubular members inserted over the standoffs 30. Spacers 40 have lower ends 42 adjacent the upper annular mounting disk surface 24 and upper ends 44.

A circular printed circuit board 50 has cylindrical walls defining holes 52 around each standoff 30. The printed circuit board 50 has a lower surface 54 adjacent the upper ends of the spacers. Retaining rings 56 are in the lower retaining ring grooves 34 adjacent an upper surface 57 of the printed circuit board 50. Circuit components 58 are fixed to the upper surface 57 of the printed circuit board interspersed about the standoffs, arranged in any one of a number of known converting and transforming circuits.

An example of the invention has been made with a circuit that converts 110V 60 Hz. household line electricity to 11.5V AC electricity with a 75 watt capacity. The circuitry design is not a part of this invention. Although it is not believed to be essential to the disclosure of the invention, the Appendix (submitted with the application and located in the file history) provides schematic diagrams and information as to the example circuit and the mounting of its circuit components.

A mounting plate 70 is fixed to a female bi-pin socket 72. The mounting plate 70 has an equilaterally-triangular with truncated corners shape. The mounting plate 70 has cylindrical internal walls defining three holes 74 extending from lower to upper planar surfaces 76,78. The standoffs 30 extend one each through the holes 74 in the mounting plate 70. Upper retaining ring grooves 80 (FIG. 7) are adjacent terminal ends 82 of the standoffs 30. Upper retaining ring grooves 80 are spaced equidistantly along the standoffs 30 from the upper annular mounting disk surface 24. Retaining rings 84 in the upper retaining ring grooves 80 are adjacent the upper surface 78 of the mounting plate 70, such that the mounting plate 70 is fixed above the circuit components 58.

Potting material 90 (FIG. 6) surrounds the spacers 40, the printed circuit board 50, the circuit components 58, the mounting plate 70 and a lower portion of the bi-pin socket 72.

In operation, the invention relates to the ability to convert any 120V light fixture so that it may incorporate any of a number of low voltage (12V) lamps. The invention allows a low voltage (12V) lamp to be mounted into a 120V medium base lamp socket. The preferred device consists of a medium base lamp socket, an electronic, a 75 W transformer that converts the 120V input to 11.5 V output, a low voltage lamp socket, and associated wiring. The Lamp Socket Adapter/Converter is screwed into any existing medium base lamp socket during operation.

The device offers a number of operational advantages over the prior art. Low voltage (12V) lamps offer a wider variety of wattage selections available to the lighting designer/user. Typically, low voltage lamps are available in 20 w, 35 w, 42 w, 50 w, and 75 w.

Low voltage lamps also offer better beam control, wider beam spreads, and higher Center Beam Candlepower (CBCP) than comparable 120V lamps. Therefore, a lower wattage low voltage lamp will provide the same light output as a higher wattage 120V lamp. Power consumption is therefore reduced, and energy savings are realized.

Chromaticity (Color Temperature) for most low voltage lamps exceeds 4700 degrees Kelvin compared to 120V incandescent lamps whose chromaticity is 2800 degrees Kelvin. Therefore, the light output is a bluer/whiter light, which eliminates most of the yellow tones of a typical 120V lamp.

The operating life of typical low voltage (12V) lamps is 3000 to 5000 hours, compared to 2000 hours life typical for 120V lamps.

The transformer circuit is designed to provide approximately 11.5V output to the low voltage lamp. By reducing the voltage to 11.5V from 12V, the lamp life increased 200%. Therefore, the low voltage lamp life, as used in this Adapter/Converter configuration, will be between 6,000 and 10,000 hours.

The invention can be mounted into any previously wired, 120V light fixture. The invention can be mounted vertically, horizontally, or any other orientation in existing 120V fixtures.

The invention may be configured for (1) a "hard" mounted low voltage socket (the low voltage socket is directly mounted to the transformer) for direct replacement of 120V incandescent lamps, (2) a low voltage socket mounted to a "pigtail" so the low voltage lamp can be mounted to a baffle, at an angle, etc. and (3) a "pigtail" with screw terminals at the end for installing PAR36, PAR46 and PAR56 lamps.

The invention adapts all 120V, medium base lamps to the following low voltage lamps: MR11 lamps, MR16 lamps, all bayonet base lamps, and PAR36, PAR46 and PAR58 lamps by incorporating the proper low voltage socket, pigtails or terminals at the output side of the Adapter/converter.

The invention allows the user to wire multiple fixtures in series without "voltage drop" concerns that typically would restrict the number of fixtures, length of wire, and wire gage. Because each lamp has its own transformer, there is no voltage drop associated with wiring multiple fixtures in series.

It will be understood that each of the elements described above, or two or more together, may also find a useful application in other types of constructions differing from the type described above.

While the invention has been illustrated and described as embodied in a particular adapter/converter, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A lamp socket adapter/converter, comprising:

a main body having a central axis and with a medium screw-base male lamp connector on a lower end and a mount on an upper end;

a plurality of standoffs extending from the mount parallel and spaced from the central axis;

a printed circuit board with walls defining holes about a medial portion of the standoffs;

circuit components fixed to an upper surface of the printed circuit board interspersed about the standoffs;

a mounting plate fixed to an output connector, the mounting plate having walls defining holes, and with the standoffs extending one each through the holes in the mounting plate; and potting material surrounding an upper portion of the mount, the printed circuit board, the circuit components, the mounting plate and a lower portion of the output connector.

2. The adapter/converter of claim 1 where the mount is an annular mounting disk, and the standoffs extend one each through walls defining holes in the mounting disk.

3. The adapter/converter of claim 2 with the mounting disk having lower and upper planar annular surfaces parallel to each other and perpendicular to the central axis.

4. The adapter/converter of claim 3 with cylindrical internal walls in the mounting disk defining three holes extending from the lower to the upper annular surfaces, the holes being parallel to the central axis and equally-spaced in the mounting disk to form an equilaterally-triangular pattern centered about the central axis, and with three standoffs extending one each through the holes in the mounting disk.

5. The adapter/converter of claim 3 with the standoffs being cylindrical rods with enlarged ends adjacent the lower annular mounting disk surface.

6. The adapter/converter of claim 4 with the standoffs being cylindrical rods with enlarged ends adjacent the lower annular mounting disk surface.

7. The adapter/converter of claim 3 with insulating spacers on the standoffs adjacent the upper annular mounting disk surface.

8. The adapter/converter of claim 5 with insulating spacers on the standoffs adjacent the upper annular mounting disk surface.

9. The adapter/converter of claim 8 with the printed circuit board having a lower surface adjacent the upper ends of the spacers.

10. The adapter/converter of claim 1 with the output connector being a female bi-pin socket.

11. A lamp socket adapter/converter, comprising:

a main body having a central axis and with a medium screw-base male lamp connector on a lower end and a mount on an upper end, where the mount is an annular mounting disk having lower and upper planar annular surfaces parallel to each other and perpendicular to the central axis;

a plurality of standoffs extending from the mount parallel and spaced from the central axis, with cylindrical internal walls in the mounting disk defining holes extending from the lower to the upper annular surfaces, the holes being parallel to the central axis and equally-spaced in the mounting disk, and with standoffs extending one each through the holes in the mounting disk;

the standoffs being cylindrical rods with enlarged ends adjacent the lower annular mounting disk surface;

insulating spacers on the standoffs adjacent the upper annular mounting disk surface;

a printed circuit board with walls defining holes about a medial portion of the standoffs;

with the printed circuit board having a lower surface adjacent the upper ends of the spacers;

circuit components fixed to an upper surface of the printed circuit board interspersed about the standoffs;

a mounting plate fixed to a female bi-pin socket, the mounting plate having walls defining holes, and with the standoffs extending one each through the holes in the mounting plate; and potting material surrounding an upper portion of the mounting disk, the spaces, the printed circuit board, the circuit components, the mounting plate and a lower portion of the bi-pin socket.

12. The adapter/converter of claim 11 with three standoffs, three holes in the mounting disk about the standoffs, and three holes in the mounting plate about the standoffs, the holes and standoffs being parallel to and equally-spaced from the central axis to form an equilaterally-triangular shape centered on the central axis.

13. The adapter/converter of claim 11 with lower retaining ring grooves in the standoffs spaced equidistantly along the standoffs from the upper annular mounting disk surface, and retaining rings in the lower retaining ring grooves adjacent the upper surface of the printed circuit board.

14. The adapter/converter of claim 12 with lower retaining ring grooves in the standoffs spaced equidistantly along the standoffs from the upper annular mounting disk surface, and retaining rings in the lower retaining ring grooves adjacent the upper surface of the printed circuit board.

15. The adapter/converter of claim 11 with upper retaining ring grooves adjacent terminal ends of the standoffs, the upper retaining grooves spaced equidistantly along the standoffs from the upper annular mounting disk surface, and retaining rings in the upper retaining ring grooves adjacent an upper surface of the mounting plate, such that the mounting plate is fixed above the circuit components.

16. The adapter/converter of claim 13 with upper retaining ring grooves adjacent terminal ends of the standoffs, the upper retaining grooves spaced equidistantly along the standoffs from the upper annular mounting disk surface, and retaining rings in the upper retaining ring grooves adjacent an upper surface of the mounting plate, such that the mounting plate is fixed above the circuit components.

17. The adapter/converter of claim 14 with upper retaining ring grooves adjacent terminal ends of the standoffs, the upper retaining grooves spaced equidistantly along the standoffs from the upper annular mounting disk surface, and retaining rings in the upper retaining ring grooves adjacent an upper surface of the mounting plate, such that the mounting plate is fixed above the circuit components.

18. A lamp socket adapter/converter, comprising:

a main body having a central axis and with a medium screw-base male lamp connector on a lower end and an annular mounting disk on an upper end;

the mounting disk having lower and upper planar annular surfaces parallel to each other and perpendicular to the central axis;

cylindrical internal walls in the mounting disk defining three holes extending from the lower to the upper annular surfaces, the holes being parallel to the central axis and equally-spaced in the mounting disk to form an equilaterally-triangular pattern centered about the central axis;

three standoffs extending one each through the three holes, the standoffs being cylindrical rods with enlarged ends adjacent the lower annular mounting disk surface;

insulating spacers on the standoffs adjacent the upper annular mounting disk surface;

a circular printed circuit board with cylindrical walls defining holes around each standoff, with the printed circuit board having a lower surface adjacent the upper ends of the spacers;

lower retaining ring grooves in the standoffs spaced equidistantly along the standoffs from the upper annular mounting disk surface;

retaining rings in the lower retaining ring grooves adjacent an upper surface of the printed circuit board;

circuit components fixed to the upper surface of the printed circuit board interspersed about the standoffs;

a mounting plate fixed to a female bi-pin socket, the mounting plate having an equilaterally-triangular with truncated corners shape, the mounting plate having cylindrical internal walls defining three holes extending from lower to upper planar surfaces, and with the standoffs extending one each through the holes in the mounting plate;

upper retaining ring grooves adjacent terminal ends of the standoffs, and spaced equidistantly along the standoffs from the upper annular mounting disk surface;

retaining rings in the upper retaining ring grooves adjacent the upper surface of the mounting plate, such that the mounting plate is fixed above the circuit components; and potting material surrounding an upper portion of the mounting disk, the spacers, the printed circuit board, the circuit components, the mounting plate and a lower portion of bi-pin socket.

* * * * *